United States Patent [19]

Wegner et al.

[11] 4,048,055

[45] Sept. 13, 1977

[54] PROCESS FOR REGENERATING AQUEOUS UREA SOLUTIONS

[75] Inventors: Hans-Georg Wegner, Toppenstedt; Maximilian Kunert, Neu-Wulmsdorf, both of Germany

[73] Assignee: Deutsche Texaco Aktiengesellschaft, Hamburg, Germany

[21] Appl. No.: 677,935

[22] Filed: Apr. 19, 1976

[30] Foreign Application Priority Data

Apr. 18, 1975 Germany ..... 2517310

[51] Int. Cl.[2] ..... C07B 21/00; C10G 43/04

[52] U.S. Cl. ..... 208/25; 260/96.5 C

[58] Field of Search ..... 208/25; 260/96.5 C

[56] References Cited

U.S. PATENT DOCUMENTS

| | | | |
|---|---|---|---|
| 2,588,602 | 3/1952 | Adams et al. | 260/96.5 C |
| 2,606,214 | 8/1952 | Higley et al. | 260/96.5 C |
| 3,954,598 | 5/1976 | Franz et al. | 208/25 |

*Primary Examiner*—Herbert Levine

*Attorney, Agent, or Firm*—Thomas H. Whaley; Carl G. Ries; William E. McNulty

[57] ABSTRACT

The useful process life of aqueous urea solutions used in mineral oil urea dewaxing processes may be significantly prolonged by contacting with an acidic ion exchange resin at least a portion of the urea solution recovered from n-paraffin-urea adduct decomposition. The useful life of these aqueous urea solutions is further enhanced by contacting the urea solution with activated carbon in addition to the ion exchange resin.

5 Claims, No Drawings

PROCESS FOR REGENERATING AQUEOUS UREA SOLUTIONS

BACKGROUND OF THE INVENTION

The invention concerns a process for regenerating aqueous urea solutions used in dewaxing mineral oil fractions by reacting said aqueous urea solutions with said mineral oil fractions, thereby forming solid n-paraffin/urea adducts; recovering said aqueous urea solutions by means of decomposition of the adducts and, optionally, purifying and, optionally, reconcentrating, and reusing said aqueous urea solutions for the formation of adducts.

The process, whereby n-paraffins contained in hydrocarbon mixtures or mineral oil fractions are separated from the same, is known. In this process, the mineral oils, preferably diluted with an organic solvent, are reacted with urea or concentrated urea solutions; the solid inclusion compounds or adducts thereby formed, comprising n-paraffins and urea, are separated from the dewaxed mineral oil, purified and finally decomposed into urea or urea solution and the crude n-paraffins. This basic form of the so-called urea dewaxing process is performed, for the most part, continuously and on a large commercial scale, in a number of different embodiments.

In one of said embodiments, disclosed for example in German Pat. No. 1,000,951, the mineral oil to be dewaxed is treated with an aqueous urea solution containing about 10–40 weight % water, and the adducts so obtained, after being separated from the dewaxed mineral oil, are purified by washing with organic solvent and finally heated, suitably by the introduction of steam, together with the addition of water. This decomposition of the adduct yields an aqueous urea solution with reduced urea concentration, which solution must be passed to a thickener or concentrator and there be restored to its original water content of about 10–40 weight %, so that it can be re-used for the formation of adducts. A similar process for reconcentrating a urea solution for recycling into the circulatory system is disclosed in German Pat. No. 1,098,657.

However, the adduct formation capacity of aqueous solutions, recycled in this manner in the system, gradually diminishes despite reconcentration, cf., for example, "Erdol und Kohle", Vol. 11 (1958), No. 9, p. 619. According to the process disclosed in German Pat. No. 1,003,894, a portion or part of the stream, about 10–20%, should be drawn continuously from said aqueous urea solutions constantly being recycled in the system. This partial stream should be passed through a regeneration zone filled with activated carbon or a similar adsorbent and then reunited with the main stream and passed to the thickener for reconcentration.

It has since been shown that in certain cases the purification process disclosed in German Pat. No. 1,003,894 is inadequate or does not remain effective long enough, with the result that the time required to form separable adducts is too great. Therefore the regenerated urea solution must eventually be disposed of although it still contains the optimum urea concentration necessary for adduct formation. Apparently, despite regenerative treatment, substances gradually build up in the circulating urea solution which inhibit adduct formation, and which either are derived from the charge mineral oil or are formed by hydrolytic decomposition of the urea.

Purification of the diluted urea solutions prior to reconcentration by means of extraction with solvents was disclosed in German Offenlegungsschrift No. 1,919,663. This known purification process is concerned, however, solely with the separation of oily impurities and cannot appreciably prolong the effective life of the aqueous urea solutions purified by this means.

It is the object of this invention to develop a simple purification process for aqueous urea solutions which ensures uninterrupted re-use of the purified urea solutions for dewaxing of mineral oils over a considerably longer period of time than was possible in previous purification processes.

SUMMARY OF THE INVENTION

Aqueous urea solutions, used in a urea dewaxing process to form solid adducts of n-paraffins and urea, are recycled for reuse in the process following decomposition of the adduct. By contacting at least a portion of the recycled aqueous urea solution with an acidic ion exchange resin, the useful life of the aqueous urea solution is significantly enhanced. Further improvements in the life of the aqueous urea solution are obtained by additionally contacting said portion with an adsorbent, such as activated charcoal.

DESCRIPTION OF THE PREFERRED EMBODIMENTS

The subject matter of this invention is a process for regenerating aqueous urea solutions used in dewaxing of mineral oil fractions wherein the urea forms solid n-paraffin/urea adducts; the said aqueous urea solutions are recovered by the decomposition of the adducts and the recovered aqueous urea solution are, optionally, purified and, optionally, reconcentrated before being reused for the formation of adducts, characterized in that, at least a partial stream of the aqueous urea solution recovered from decomposition of said adducts is passed through a fixed bed of acidic ion exchange resin.

As in the purification process disclosed in German Pat. No. 1,003,894, so in the process of this invention, only a portion of the urea solution recovered from decomposition of the adducts need be passed through a fixed bed of the ion exchange resin. However, should the urea solution contain exceptionally large amounts of inhibitor, the entire solution can be passed through the fixed bed without difficulty.

It is often advisable to first carry out preliminary purification of the recovered urea solution according to the process of German Pat. No. 1,003,894, using an adsorbent, preferably activated carbon. After this treatment the urea solution is passed through the fixed bed of the acidic ion exchange resin as discussed above. Commercial acidic ion exchange resins usefully employed in this process remain stable up to a temperature of from 120°–130° C over a long period. The urea solutions to be purified usually collect in the decomposers of urea dewaxing plants at temperatures of about 85° C. If decomposition of the adduct is performed in a closed container by means of addition of an organic solvent, as disclosed in German Pat. No. 1,945,902, the temperature of the urea solution can in that case be about 76° C or below. The recovered urea solutions can therefore undergo immediate purification according to the process of our invention at the temperature which said aqueous urea solutions have attained in the decomposer, without impairing the ion exchange resin. If necessary, the urea solution to be purified, or a partial stream thereof, can additionally be cooled to a point at which no reduction in the effective life of the ion exchange resin occurs. Moreover, ion exchange resins of this type, used for purifying urea solutions over a long period of time, can easily be regenerated by treatment with water or acid solutions, and can be restored to their original effectiveness for purification purposes.

The effectiveness for purification purposes of acidic ion exchange resins is all the more surprising because their exchange capacity is relatively limited. For the ion exchange resins used in the following examples said exchange capacity was about 2.1 acid group equivalents per liter of resin. it had therefore to be assumed that when a column containing 1 liter of said ion exchange resin is loaded with a solution comprising approx. 75 weight % of monobasic urea (molecular and equivalent weight of approx. 60) practically all of the resin's acid groups are neutralized with urea by the formation of salt, after 137 ml of said urea solution (corresponding to 2.1 equivalents urea) has been introduced into the fixed bed. It has since been found that said solution can be passed through the fixed bed of the ion exchange resin with a liquid hourly space velocity of 3 - 5 v/v/hr, over a period of hours without measurably diminishing the effectiveness of said ion exchange resin for purification purposes.

The process of the invention is further explained in the following examples:

COMPARATIVE EXAMPLE

A first portion of an n-paraffin base mineral oil distillate having a boiling range of from 325° - 400° C and the following properties:

| | | |
|---|---|---|
| Refractive index $n_D30$ | = | 1.4910 |
| Density, g/ml, $d_{15}$ | = | 0.895 (26.6 ° API) |
| Viscosity, cSt. at 37.8 ° C | = | 19.6 |
| Viscosity, cSt. at 70° C | = | 7.1 |
| n-paraffin content weight % | = | 17.2 |

was reacted with an aqueous urea solution saturated at a temperature of 70° C, containing 76.4 weight % urea and 23.5 weight % water, at a temperature of 30° C, under the following conditions:

100 parts per volume mineral oil distillate
120 parts per volume urea (in the form of an aqueous solution saturated at 70° C)
200 parts per volume hexane.

Small, solid-free samples were taken continuously from the reaction mixture at intervals of from 1 - 10 mins., and the refractive index ($n_D^{30}$) of the dewaxed mineral oil filtrate was measured, in order to determine, by means of this value, the progress and completeness of the dewaxing process. After 45 min. the entire reaction mixture was filtered; the filtered-off n-paraffin/urea adduct was washed with hexane and decomposed at a temperature of approx. 80° C., 1 part by weight water being added per 18 parts by weight adduct. The entire diluted urea solution so obtained, containing 28.7 weight % water, was passed through a column filled with fresh activated carbon, and subsequently thickened to attain its original urea concentration of 76.4 weight % by evaporation of the water at a temperature of 85° C (under an absolute pressure of 0.3 bar). The entire cycle was repeated ten times in all with further portions of the same mineral oil distillate charge material. The refractive index values, obtained during the 1st, 5th and 10th dewaxing cycle, are set forth in the following table:

| Adduction time, minutes | Refractive index $n_D^{30}$ of the dewaxed mineral oil filtrate | | |
|---|---|---|---|
| | 1st cycle | 5th cycle | 10th cycle |
| 0 | 1.4910 | 1.4910 | 1.4910 |
| 1 | 1.4912 | 1.4915 | 1.4910 |
| 3 | 1.4972 | 1.4974 | 1.4912 |
| 5 | 1.4993 | 1.4986 | 1.4912 |
| 10 | 1.5010 | 1.4986 | 1.4915 |
| 15 | 1.5010 | 1.4988 | 1.4923 |
| 25 | 1.5010 | 1.4996 | 1.4968 |
| 35 | 1.5010 | 1.4998 | 1.4995 |
| 45 | 1.5010 | 1.5000 | 1.5005 |

As shown by these values, in the 1st cycle, using fresh urea solution, a constant refractive index was reached after only 10 minutes, thus indicating that adduct formation was complete. In the 5th cycle, more than 45 minutes was necessary for the completion of said adduct formation, although the entire recovered urea solution was constantly purified with fresh activated carbon (according to German Pat. No. 1,003,894). The activity of the urea solution, i.e. the amount of n-paraffin recoverable per unit of time, had thus fallen, after only four regeneration processes, to less than ¼.

Example 1

The comparative example was repeated under identical conditions, however, a column filled with the acidic ion exchange resin "Amberlite IR-122" was inserted between the activated carbon column and the thickener for the diluted urea solution. The urea solution, with a liquid space velocity of about 3 volumes per volume of resin per hour, was passed through a fixed bed of said resin. The experimental values for the refractive index of the dewaxed mineral oil filtrate are given in Example 2.

Example 2

Example 1 was repeated with one modification, in that urea solution was passed initially over the acidic exchange resin and subsequently over the activated carbon. The following refractive index values were measured:

| Adduction time, minutes | Refractive index $n_D^{30}$ of the dewaxed mineral oil filtrate | | |
|---|---|---|---|
| | 1st cycle | 10th cycle | 20th cycle |
| 0 | 1.4910 | 1.4910 | 1.4910 |
| 1 | 1.4912 | 1.4915 | 1.4912 |
| 3 | 1.4975 | 1.4975 | 1.4973 |
| 5 | 1.4995 | 1.4998 | 1.4995 |
| 10 | 1.5005 | 1.5010 | 1.5005 |
| 15 | 1.5010 | 1.5010 | 1.5010 |
| 25 | 1.5010 | 1.5010 | 1.5010 |
| 35 | 1.5010 | 1.5010 | 1.5010 |
| 45 | 1.5010 | 1.5010 | 1.5010 |

The results of Examples 1 and 2 were identical. Even after 20 adduction cycles, using the same urea solution, no reduction in said urea solution's activity could be ascertained. In the 1st, 10th and 20th cycle the time taken to attain a constant refractive index was 10 - 15 minutes in each case.

Example 3

The process disclosed in Examples 1 and 2 was repeated under the conditions set forth therein, using, however, only the column filled with the acidic ion exchange resin, i.e. omitting the column filled with activated carbon.

The results obtained up to and including the 10th cycle were identical to the corresponding results shown in the table of Example 2. Only subsequent to the 10th cycle were the divergences set forth in the following table observed:

| Adduction time, minutes | Refractive index $n_D^{30}$ of the dewaxed mineral oil filtrate | | |
|---|---|---|---|
| | 1st cycle | 10th cycle | 20th cycle |
| 0 | 1.4910 | 1.4910 | 1.4910 |
| 1 | 1.4912 | 1.4915 | 1.4911 |
| 3 | 1.4975 | 1.4975 | 1.4955 |
| 5 | 1.4995 | 1.4998 | 1.4974 |
| 10 | 1.5005 | 1.5010 | 1.4990 |
| 15 | 1.5010 | 1.5010 | 1.4995 |
| 25 | 1.5010 | 1.5010 | 1.5010 |
| 35 | 1.5010 | 1.5010 | 1.5010 |
| 45 | 1.5010 | 1.5010 | 1.5010 |

A comparison of the above values with those in the table of Example 2 shows that a slight increase, of about 5 - 10 minutes in the reaction time necessary for complete adduct formation did not become apparent until the 20th cycle. Urea solutions can thus be satisfactorily regenerated using only the ion acidic exchange resin. However, additionally purifying the urea solution with an adsorbent, particularly activated carbon, either prior to or subsequent to the treatment with the ion exchange resin, is preferable. This method, as shown in Examples 1 and 2, increases still further the activity and effective life of the urea solutions.

We claim:

1. In a process for regenerating aqueous urea solutions used in dewaxing of mineral oils containing n-paraffins by (a) reacting said urea solutions with said mineral oils to form solid n-paraffin-urea adducts, (b) recovering said urea solutions by decomposition of said adducts and, (c) reusing said urea solutions for the formation of adducts, the improvement which comprises:

passing at least a portion of said aqueous urea solution recovered from the decomposition of said adducts in contact with acidic ion exchange resin.

2. A process according to claim 1 wherein the acidic ion exchange resin is present in a fixed bed.

3. A process according to claim 1 including the following additional step:

passing said portion of said aqueous urea solution in contact with activated charcoal.

4. A process according to claim 3 wherein the aqueous urea solution is contacted with the activated charcoal prior to being contacted with the acidic ion exchange resin.

5. A process according to claim 3 wherein the aqueous urea solution is contacted with the activated charcoal subsequent to being contacted with the acidic ion exchange resin.

* * * * *